US006138376A

United States Patent [19]

Garfinkel

[11] Patent Number: 6,138,376

[45] Date of Patent: Oct. 31, 2000

[54] PASSIVE WET HAIR STRAIGHTENING

[76] Inventor: Jane E. Garfinkel, 1277 Dillon Ave., Cincinnati, Ohio 45208

[21] Appl. No.: 09/398,249

[22] Filed: Sep. 17, 1999

[51] Int. Cl.[7] ..... A45D 20/00

[52] U.S. Cl. ..... 34/283; 34/98; 34/99; 34/101

[58] Field of Search ..... 34/283, 96, 97, 34/98, 99, 101; 132/205, 207, 209, 231; 424/70.2, 70.6; 392/380, 384; 219/222

[56] References Cited

U.S. PATENT DOCUMENTS

| | | | |
|---|---|---|---|
| 3,662,767 | 5/1972 | Murtha | 132/9 |
| 3,692,032 | 9/1972 | Regas | 132/9 |
| 4,242,567 | 12/1980 | Carter | 219/225 |
| 4,671,302 | 6/1987 | Hill | 132/9 |
| 5,228,465 | 7/1993 | Hill | 132/212 |
| 5,294,777 | 3/1994 | Denhup | 219/225 |
| 5,400,809 | 3/1995 | Adams | 34/101 X |
| 5,526,578 | 6/1996 | Iyer | 34/97 |
| 5,553,632 | 9/1996 | Burkhardt | 34/101 X |
| 5,865,188 | 2/1999 | Marquez | 132/132 |

*Primary Examiner*—Stephen Gravini
*Attorney, Agent, or Firm*—Gina S. Tollefson

[57] ABSTRACT

A hair straightening device and method usable with a conventional blow dryer that dries wet hair in a straight configuration from the scalp to the end of the hair strands with minimal heat damage to the hair and without hair tangling problems of conventional methods. The method and device includes two elongated elements coupled in an open/close relationship. The device operates by securing wet hair between the elongated elements and slowly pulling the device along the length of the hair strand while exposing the hair strands to heated air from a conventional blow dryer.

12 Claims, 2 Drawing Sheets

PASSIVE WET HAIR STRAIGHTENING

BACKGROUND OF THE INVENTION

This invention relates to the field of hair styling apparatus and more particularly to a hair styling device for producing straight hair when used with an external hair blow dryer.

Traditionally, appliances in the field of hair styling are directed toward producing a wavy or curly hair configuration as dictated by popular styles. More recently, the desired feminine glamour look includes short to medium length hair completely straight from the scalp to the end of the hair strands. It is however a challenge for those with naturally curly hair to achieve such a straight style.

It is known that wet hair that it is heated generally retains the configuration it had during the heating process. Various methods of drying wet hair to achieve a straight style have been attempted with limited success. It is known to blow dry wet, curly hair using a large, round brush, a brush that contains bristles around the entire brush barrel. To use such a brush, the hair is engaged in one radial plane of the brush bristles and the ends of the hair strands are engaged by an adjacent plane of the brush, that is, the hair is very slightly wound around the brush, in order to secure the hair and provide a slight degree of tension to straighten the wet hair while external heat is applied. The drawbacks of this method are that the hair generally contains a slight curl at the ends, and the hair, especially near the scalp, is often unintentionally wound around the bristles of the brush in such a manner that the brush cannot be disengaged from the hair. The brush may become disengaged from the hair by repeated pulling or twisting of the brush to disengage the hair strands.

It is also known to provide an electrically powered straightening iron in which a large amount of hair can be grasped. Such devices are however damaging to the hair strands because the hair is in direct contact with electrical elements which causes hair to break. Additionally, such devices generally provide optimal straightening when the hair is dry or nearly dry. Accordingly, a user must wait while the hair naturally dries or by blow drying the hair which adds time to the total styling process. Only then can such devices be used effectively.

Other known methods of straightening curly hair include using devices resembling clips that contain heating elements. Here hair is engaged by spring pressure between two elongated clips and heated. Upon removal of the clips, the hair is straight where contact was made. Some such devices are only intended for use at the scalp to straighten or provide lift to the hair and this configuration is not suitable for straightening the entire hair strand. Because wet hair is more fragile than dry hair, the drawbacks of this method include hair damage caused by direct contact with heating elements. Another drawback is the requirement to heat the clip by either inserting it in a separate heating element or connecting it into an electrical power source. The requirement to heat the clip adds time to the total hair styling process.

The present invention straightens wet, curly hair when used with a conventional blow dryer while overcoming the limits of prior devices and methods. The present invention eliminates the time consuming step of drying or nearly drying the hair before using a hair straightening device and device preheating, thereby minimizing total styling time. The present invention has the capability to straighten curly hair the entire length of the hair strand, eliminates any possibility of hair entanglement, minimizes heat damage to hair, uses an existing source of heat energy, is small and lightweight and is inexpensive to manufacture and easy to use.

SUMMARY OF THE INVENTION

The present invention provides a hair straightening device and method usable with a conventional blow dryer that dries wet hair in a straight configuration from the scalp to the end of the hair strands with minimal heat damage to the hair and without hair tangling problems of conventional methods. The device includes two elongated elements connected by a hinge in a biasing relationship and operates by securing wet hair between the elongated elements and slowly pulling the device along the length of the hair strand while exposing the hair strands to heated air from a conventional blow dryer.

It is therefore an object of the invention to provide a hair straightening device and method that operates without hair entanglement.

It is another object of the invention to provide a hair straightening device and method that straightens hair using an existing form of heat energy.

It is anther object of the invention to provide a hair straightening device and method that is used like a conventional blow dryer operation.

It is another object of the invention to provide a hair straightening device and method that is small and lightweight.

It is another object of the invention to provide a hair straightening device and method that operates with a conventional blow dryer as the hair heating source.

It is another object of the invention to provide a hair straightening device and method that operates without internal electrical heating elements and results in minimal heat damage to the hair strand.

It is another object of the invention to provide a hair straightening device that is inexpensive to manufacture and easy to use.

These and other objects of the invention are described in the description, claims and accompanying drawings and are achieved by a wet hair straightening device usable with an external heated air blowing source for styling hair from the scalp to the end of the hair strands comprising:

first and second flat, heat conducting elongated elements having a gripping handle at one end;

said first and second flat, elongated elements having a plurality of heated-air receiving perforations therein; and a connecting element connecting said first and second flat, elongated elements in a moveable relationship comprising a receiving mode with said first and second flat, elongated elements in an open position for receiving wet hair therein and an engaging mode with said first and second flat, elongated elements in a closed position holding wet hair therein in a secure, slightly compressed condition;

said wet hair secured in said hair straightening device drying in a straight style upon application of heated air from said external hair blowing heated air source.

DETAILED DESCRIPTION

Figure 1:
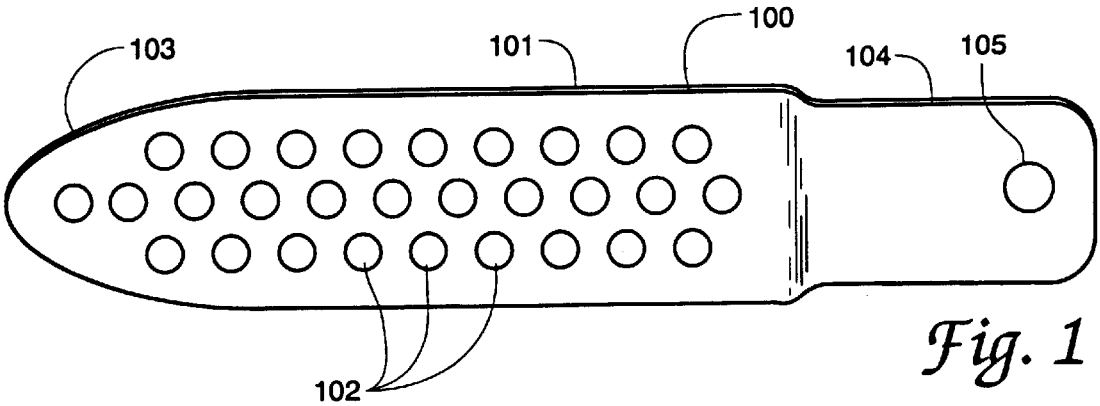
FIG. 1 shows a top view of the hair straightening device in accordance with the invention.

FIG. 1 shows a top view of the hair straightening device in accordance with the invention. A first flat, elongated element is shown at 100 and a second flat, elongated element is shown at 101, both elements having a blunt tip shown at 103. The first and second flat, elongated elements, 100 and 101, may be made of a sturdy, heat resistant material such as nylon to withstand prolonged use. A heat conducting material may also be selected to facilitate the passage of heat to the hair strands and minimize drying time. In the configuration of FIG. 1, the blunt tip is shown rounded, but any shape that is user safe and consistent with the objects of the invention may be used at the ends of the elongated elements.

The first flat, elongated element 100 is positioned on top of the hair furthest away from the scalp when operating the device, that is, it holds hair strands between itself and the second, flat elongated element 101 when the device is in a closed position. The first flat, elongated element 100 and the second flat, elongated element 101 contain circular perforations 102 that allow heated air from a hair blow dryer to pass through the device and dry the hair clasped within the device. The perforations within the first, flat elongated element 100 are aligned with the perforations in the second flat, elongated element 101 to facilitate the flow of heated air through the hair and further minimize hair drying time. The perforations 102 in the arrangement of FIG. 1 are of a circular shape, however any suitable shape and size that would facilitate passage of heated blown air may be used.

A top finger gripping handle of the device is shown at 104 in FIG. 1 and a hole for hanging the FIG. 1 device on a peg in a bathroom, for instance, is shown at 105. In the arrangement of FIG. 1, the finger gripping handle 104 is integral with elongated element 100 for ease of manufacture.

Figure 2:
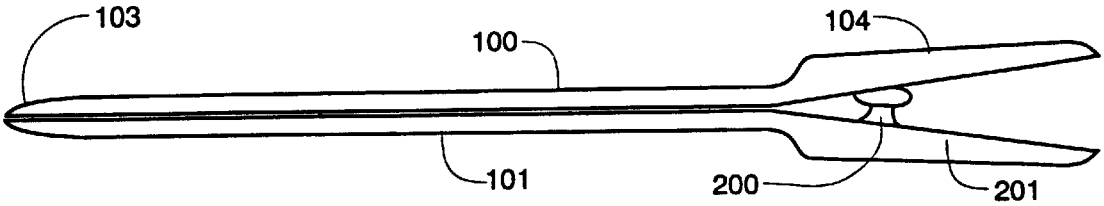
FIG. 2 shows a side view of the hair straightening device in accordance with the invention.

FIG. 2 shows a side view of the hair straightening device of the invention. The first flat, elongated element containing circular heated air pathways is shown at 100 with a rounded tip 103 and the second flat, elongated element is shown at 101. The finger gripping handles 104 and 201 are positioned above and below a spring loaded hinge 200 in the arrangement of FIG. 2. As suggested by FIG. 2 the device of the present invention is intended to be lightweight and easy to handle and maneuver with one hand in as much as a user's second hand is occupied with a hair blow dryer.

Figure 3:
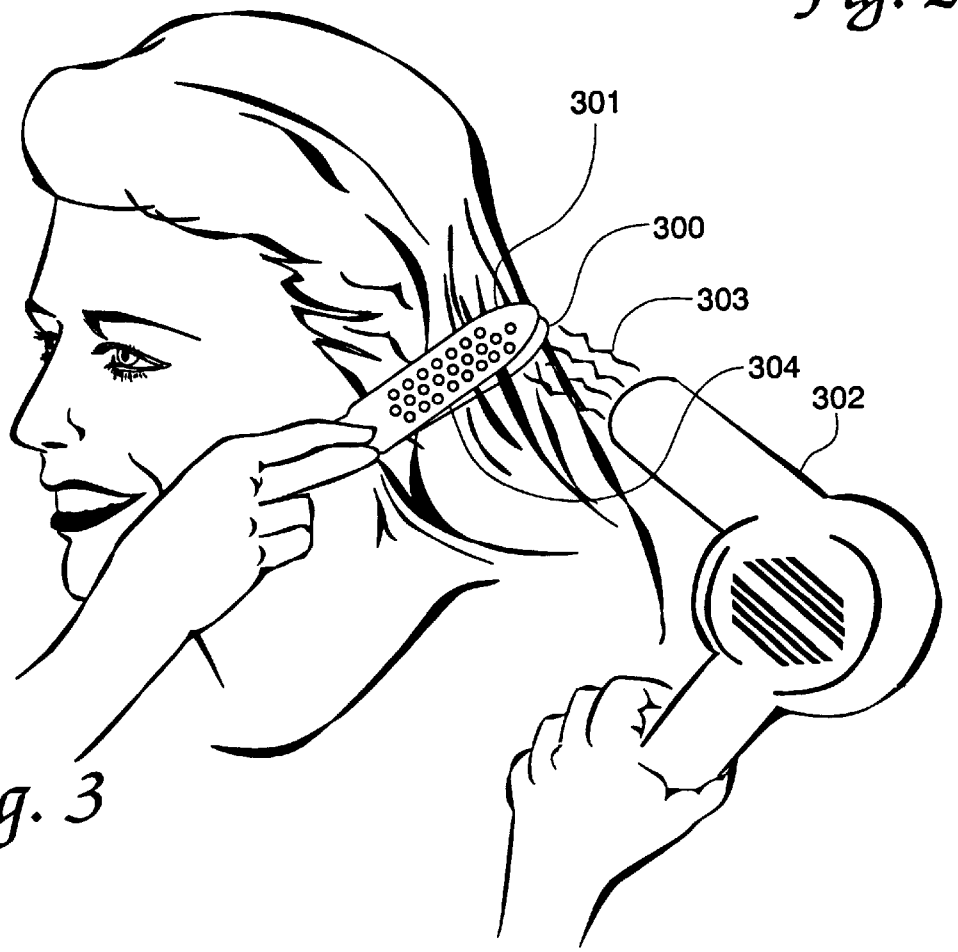
FIG. 3 shows the hair straightening device in operation with an external heat source in accordance with the invention.

FIG. 3 shows the hair straightening device in operation with an external heat source in accordance with the invention. The blow dryer 302 blows heated air 303 at temperatures within the range of conventional blow dryers toward the hair desired to be straightened. The hair straightening device of the invention as shown in FIG. 3 contains a quantity of wet hair positioned between the top elongated member 300 and the bottom elongated member 301. The first and second elongated members should be in a relatively aligned position with the rounded tip of each element, 103 in FIGS. 1 and 2, thereby exerting slight tension on the hair clamped therebetween when the device is gently pulled away from the head. The hair contacting sides of the first and second flat, elongated elements may be slightly textured to provide resistance to the hair strands so that the hair will remain secured and not slip out during application of heated air from the hair blow dryer.

The quantity of hair positioned within the device can be selected depending on the thickness of the hair being straightened and the desired speed at which straightening will occur. An excessively large portion of hair secured between the elongated members limits the tension exerted by the clamp and possibly results in a wavy rather than straight hair style. Preferably, a smaller portion of thick hair relative to thin hair is inserted into the hair straightening device. Hair that is extremely curly or thick should be inserted in the device in smaller quantities and will take longer to straighten than wavy or thin hair.

Figure 4:
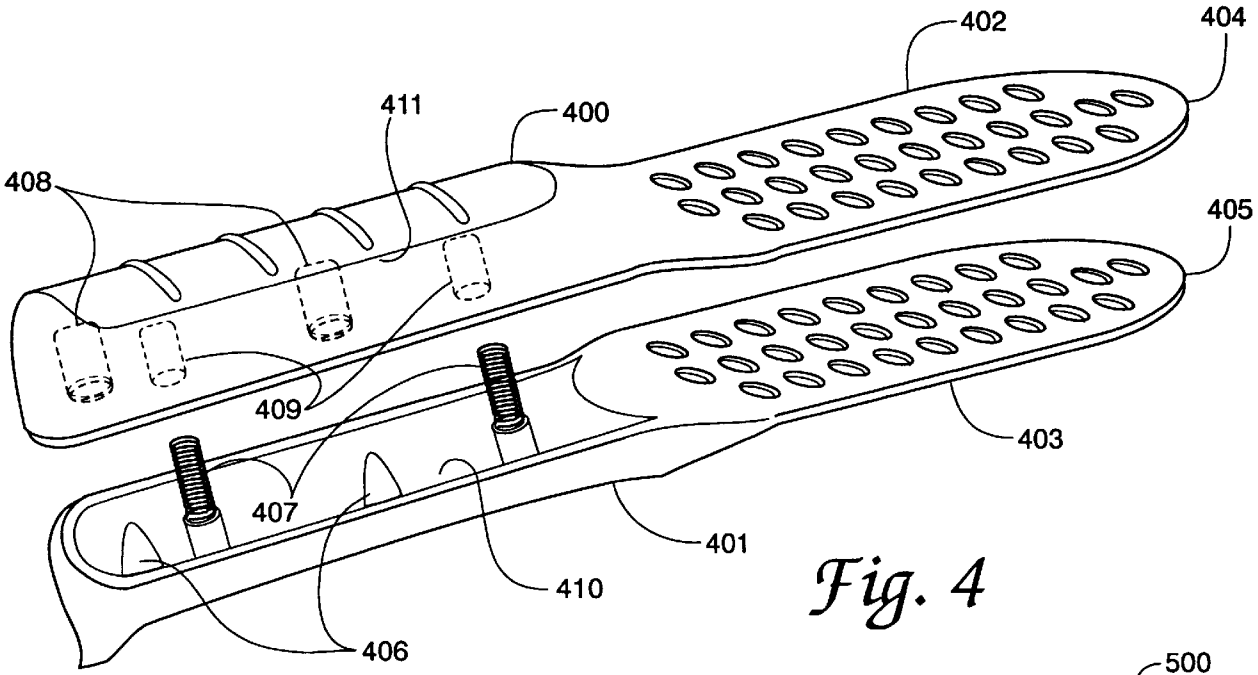
FIG. 4 shows a spring-based connecting element arrangement of the hair straightening device of the present invention.

FIG. 4 shows the device of the invention in a parallel action second embodiment with one possible spring-based connecting element. FIG. 4 is provided by way of example, and any connecting element arrangement may be used to operate the elongated elements in a open/closed relationship. In the FIG. 4 embodiment, the elongated elements for securing hair strands therebetween are shown at 402 and 403 and are respectively integrated with the gripping handle elements 400 and 401. Gripping handle element 400 has an arch configuration with a finger gripping convex outer rounded side and spring receiving elements 409 and alignment pin receiving elements 408 on an inner or concave side. The alignment pin receiving element 408 and spring receiving element 409 are integral with the finger gripping handle element 400. The finger gripping handle element 401 has an outer arched finger gripping side and an elongated cup-like receptacle on the inner side containing two springs 407 and two alignment pins 406.

In operating the arrangement of FIG. 4, the alignment pins 406 are engaged within the alignment pin receiving elements. The hinge is in a closed position when the operator squeezes on the finger gripping handles to exert tension on the wet hair between the elongated elements. In the closed position the springs 407 are compressed within the spring receiving elements 409 and the alignment pins 406 are fully received within the alignment pin receiving elements 408.

Figure 5:
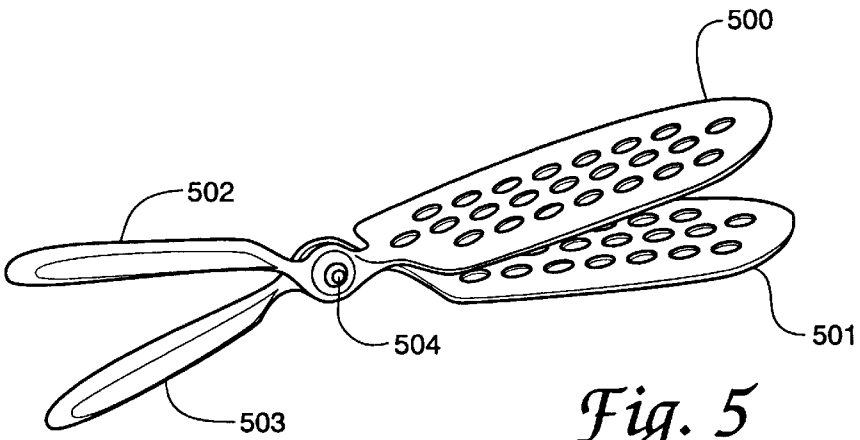
FIG. 5 shows a pivot-pin based connecting element arrangement of the hair straightening device of the present invention.

Another possible connecting arrangement for use in the present invention includes the pivot-pin based connecting element as shown in FIG. 5. The pivot-pin based connecting element operates much like or tongs and may have either the force provided opening (as shown in FIG. 5) or a force provided closure relationship. In FIG. 5, the first elongated element with heated air receiving perforations is shown at 500 and the second, bottom elongated element is shown at 501. The elongated elements 500 and 501 are integral with finger gripping handles 503 and 502, respectively. A pivot pin 504 connects the elongated elements 500 and 501 near their midpoint. When finger gripping handles 502 and 503 are unengaged, elongated elements 500 and 501 are in an open position and wet hair can be inserted therebetween. Depressing the finger gripping handles 502 and 503 causes elongated elements 500 and 501 to close to a biased position and secure wet hair therebetween. Upon application of heated air from a conventional blow dryer, the device can slowly be moved down the hair strand resulting in dry hair with a straight configuration.

The present invention straightens wet, curly hair when used with a conventional blow dryer while overcoming the limits of prior devices and methods. The present invention has the capability to straighten curly hair the entire length of the hair strand, eliminates any possibility of hair entanglement, minimizes heat damage to hair and is inexpensive to manufacture and easy to use.

While the apparatus and method herein described constitute a preferred embodiment of the invention, it is to be understood that the invention is not limited to this precise form of apparatus or method and that changes may be made therein without departing from the scope of the invention which is defined in the appended claims.

What is claimed is:

1. A wet hair straightening device usable with an external heated air blowing source for styling hair from the scalp to the end of the hair strands comprising:

first and second flat, heat conducting elongated elements having a gripping handle at one end;

said first and second flat, elongated elements having a plurality of heated-air receiving perforations therein;

a connecting element coupling said first and second flat, elongated elements in a moveable relationship comprising a receiving mode with said first and second flat, elongated elements in an open position for receiving wet hair therein and an engaging mode with said first and second flat, elongated elements in a closed position holding wet hair therein in a secure, slightly compressed condition; and heated air from an external hair blowing heated air source applied to said wet hair engaged within said first and second flat, elongated elements at the scalp of a users head and along the entire length of the hair as the hair straightening device is slowly pulled down the hair strand, thereafter said hair dried in a straight configuration.

2. The hair straightening device of claim 1 wherein said plurality of heated-air receiving perforations comprise a plurality of circular heated air receiving pathways.

3. The hair straightening device of claim 1 wherein said plurality of heated-air receiving perforations within said first, flat elongated element are aligned with said plurality of heated-air receiving perforations within said second, flat elongated element.

4. The hair straightening device of claim 1 wherein hair contacting surfaces of said first and second flat, elongated elements are textured.

5. The hair straightening device of claim 1 wherein said first and second flat, elongated elements are comprised of a heat conducting material.

6. The hair straightening device of claim 1 operable up to temperatures of blow dryers.

7. A hair straightening method for styling wet hair from a scalp to the end of the hair strands comprising the steps of:

providing first and second flat, elongated elements connected in a bias relationship and having gripping handles at one end;

opening said first and second flat, elongated elements and receiving a plurality of wet hair strands therebetween, said second flat, elongated element being close to said scalp;

closing said first and second flat, elongated elements until said first and second flat, elongated elements are in close proximity and said plurality of wet hair strands are secured therebetween;

blowing heated air from an external heat source through a plurality of perforations in said first flat elongated element; and slowly pulling said first and second flat, elongated elements by said gripping handles down said hair strand to import a dry and straight condition to said strands.

8. The hair straightening method of claim 7 wherein said blowing step further includes blowing heated air from an external heat source through a plurality of circular perforations in said first and second flat, elongated element.

9. The hair straightening method of claim 8 wherein said blowing step further includes blowing heated air from an external heat source through a plurality of aligned circular perforations in said first and second flat, elongated elements.

10. The hair straightening method of claim 7 wherein said providing step further includes providing first and second flat, elongated elements hingably connected by spring activated hinge means.

11. The hair straightening method of claim 10 wherein said closing step further includes the step of depressing said gripping handles, said depressing step engaging alignment pins and alignment pin receiving receptacles and springs and spring receiving receptacles thereby causing blunt tips of said first and second flat elongated elements to be in close proximity.

12. The hair straightening method of claim 7 wherein said opening step further includes the step of depressing said gripping handle elements into an open biased position and receiving a plurality of wet hairstrands therebetween.

* * * * *